US010317053B2

(12) United States Patent
Dunn et al.

(10) Patent No.: US 10,317,053 B2
(45) Date of Patent: Jun. 11, 2019

(54) CLAMP FOR HOLDING A FLEXIBLE LIGHTING UNIT

(71) Applicant: B/E AEROSPACE, INC., Wellington, FL (US)

(72) Inventors: Matthew Dunn, Stony Brook, NY (US); Anthony Catania, Huntington, NY (US); Eric Johannessen, Holbrook, NY (US)

(73) Assignee: B/E Aerospace, Inc., Winston Salem, NC (US)

( * ) Notice: Subject to any disclaimer, the term of this patent is extended or adjusted under 35 U.S.C. 154(b) by 300 days.

(21) Appl. No.: 15/460,555

(22) Filed: Mar. 16, 2017

(65) Prior Publication Data

US 2018/0051867 A1 Feb. 22, 2018

Related U.S. Application Data

(60) Provisional application No. 62/377,460, filed on Aug. 19, 2016.

(51) Int. Cl.

| | |
|---|---|
| ***F21S 4/24*** | (2016.01) |
| ***F21V 21/02*** | (2006.01) |
| ***F21V 21/088*** | (2006.01) |
| ***F21Y 103/10*** | (2016.01) |
| ***F21Y 107/70*** | (2016.01) |
| ***F21Y 115/10*** | (2016.01) |

(52) U.S. Cl.

CPC ..... *F21V 21/088* (2013.01); *F21S 4/24* (2016.01); *F21V 21/02* (2013.01); *F21Y 2103/10* (2016.08); *F21Y 2107/70* (2016.08); *F21Y 2115/10* (2016.08)

(58) Field of Classification Search

CPC ..... F21S 4/24; F21V 21/02; F21V 21/088; F21Y 2103/10; F21Y 2107/70; F21Y 2115/10; H05K 1/189

See application file for complete search history.

(56) References Cited

U.S. PATENT DOCUMENTS

| | | | | |
|---|---|---|---|---|
| 4,597,033 | A | 6/1986 | Meggs et al. | |
| 4,597,690 | A | 7/1986 | Girard | |
| 7,114,841 | B2 * | 10/2006 | Aanegola | F21V 21/002 362/640 |
| 9,546,779 | B2 * | 1/2017 | Rementer | F21V 23/0414 |

(Continued)

FOREIGN PATENT DOCUMENTS

| | | | |
|---|---|---|---|
| CN | 2602251 | Y | 2/2004 |
| JP | S58-172174 | U | 11/1983 |

OTHER PUBLICATIONS

European Search Report issued in related application EP 17187099.1, dated Dec. 7, 2017, 8 pages.

*Primary Examiner* — Peggy A Neils

(74) *Attorney, Agent, or Firm* — Donna P. Suchy

(57) ABSTRACT

A clamp for holding a twisted lighting unit includes a body member having a slot extending from its top wall to its base. The slot extends from an end wall to a side wall to create a passage for receiving a twisted portion of a lighting unit. Parallel surfaces are provided over a portion of the width of the passage to hold the lighting unit in its intended position. Various curves in the slot receive the twist itself and facilitate insertion of the clamp on the lighting unit and reduce the strain experienced along the edge of the lighting unit.

17 Claims, 1 Drawing Sheet

(56) References Cited

U.S. PATENT DOCUMENTS

| | | | | |
|---|---|---|---|---|
| 2002/0149933 | A1 | 10/2002 | Archer et al. | |
| 2004/0129846 | A1* | 7/2004 | Adams | F21V 21/088 248/231.81 |
| 2012/0000104 | A1 | 1/2012 | Peeters et al. | |
| 2012/0051064 | A1 | 3/2012 | Schevardo et al. | |
| 2016/0312949 | A1* | 10/2016 | Chi Man | F16M 13/022 |

* cited by examiner

CLAMP FOR HOLDING A FLEXIBLE LIGHTING UNIT

CROSS-REFERENCE TO RELATED APPLICATIONS

The present application claims the priority benefit of U.S. Provisional Patent Application 62/377,460, filed on Aug. 19, 2016 and incorporated herein by reference.

TECHNICAL FIELD

The present disclosure relates generally to lighting and, more particularly, to clamp for holding a flexible lighting unit.

BACKGROUND

There have been various uses of lighting units, such as for cabin lighting in an aircraft. One form of lighting unit includes a printed circuit board ("PCB") having electronics and light-emitting diodes ("LEDs").

DRAWINGS

While the appended claims set forth the features of the present techniques with particularity, these techniques, together with their objects and advantages, may be best understood from the following detailed description taken in conjunction with the accompanying drawings of which:

DESCRIPTION

The disclosure is generally directed to a clamp for holding a flexible lighting unit in its intended orientation. In various embodiments, a flexible lighting unit may be twisted and easily mounted with the clamp.

In an embodiment, the clamp includes a body member having a base with spaced side walls and intermediate end walls which extend upwardly from the base. A top wall is formed by the tops of the side walls and end walls. A slot extends downwardly from the top wall toward the base through an end wall and a side wall to form a passage completely through the body member. The passage is bounded by surfaces inwardly of the end wall and side wall. The surfaces have planar portions parallel to each other over a portion of the passage width for contacting an encased PCB outwardly of the twist. The remainder of the passage is shaped to accommodate the twist itself.

Figure 1:
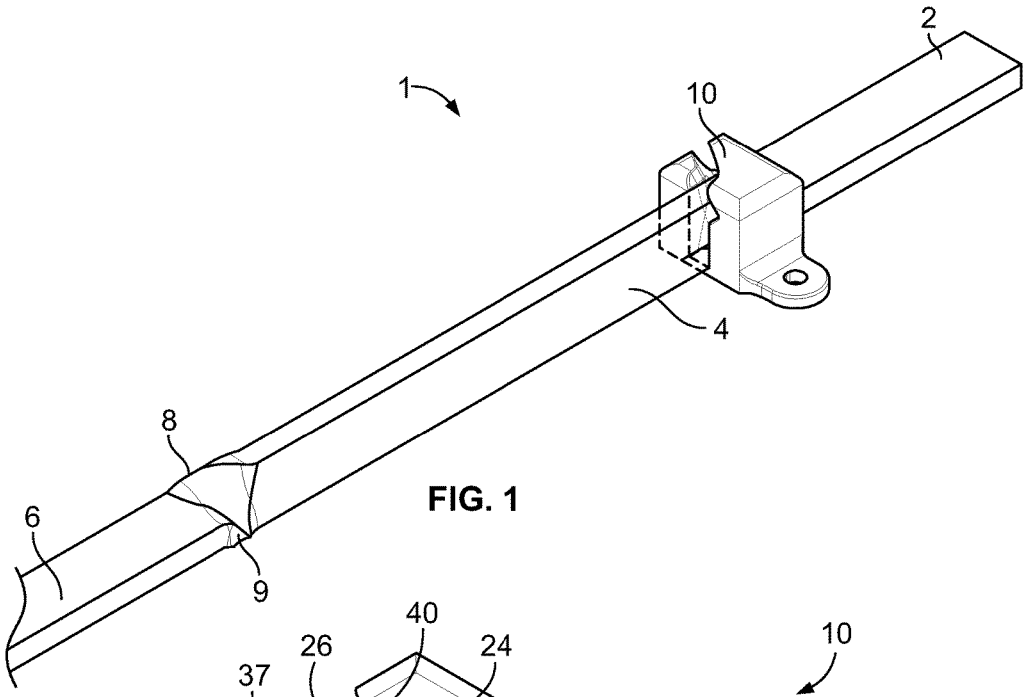
FIG. 1 is an isometric view of lighting unit having a clamp at a twisted portion according to an embodiment.

FIG. 1 shows a lighting unit 1, which includes a PCB having electronics and LEDs encased in a flexible material, such as silicone. Although the flexible material can be easily bent and stretched, the encased PCB generally cannot. There are, however, circumstances where it is necessary to change the orientation of the PCB along different portions of the length of the lighting unit. As shown in FIG. 1 one portion 2 is in a generally horizontal orientation, while its adjacent portion 4 has been twisted 90 degrees to a generally vertical orientation. Portion 6 is then twisted to a horizontal orientation. FIG. 1 illustrates the location of a twisted portion 8 between portions 4 and 6. The twisted portion 8 may include small cutouts 9 on its sides to allow the PCB to twist. FIG. 1 also illustrates a clamp 10 in accordance with an embodiment. The clamp 10 (also referred to herein as a "Fusilli clamp") maintains the adjacent portions 2 and 4 in their intended orientation. A similar clamp 10 would also be located at the twisted portion 8 to maintain lighting unit portions 4 and 6 in their intended orientation.

Figure 2:
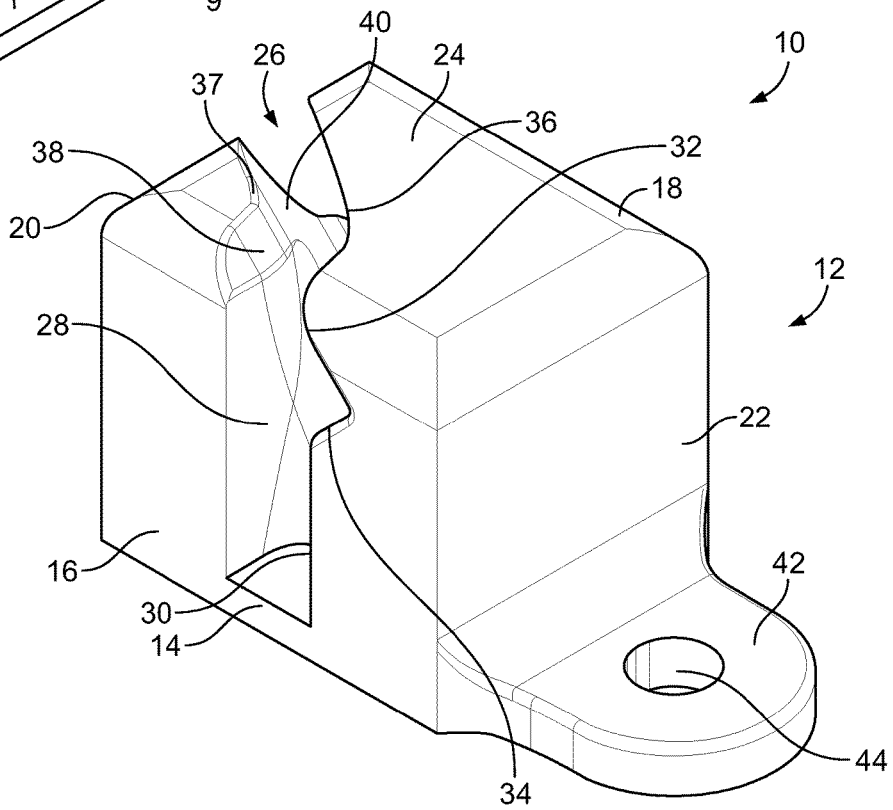
FIG. 2 is an isometric view of the clamp shown in FIG. 1.

FIG. 2 is an isometric view of a clamp 10 in accordance with an embodiment. As shown therein, clamp 10 is in the form of a body member 12 having a base or bottom wall 14. A pair of upstanding side walls 16 and 18 are located between intermediate upstanding end walls 20 and 22. Body member 12 also includes a top wall 24 created at the tops of the side walls and end walls. A slot 26 extends downwardly from the top wall at side wall 16 and end wall 20 toward the base 14. The slot 26 extends completely through each wall 16 and 20 to form a passage completely through body member 12 from side wall 16 to end wall 20. The passage is bounded by surfaces shaped to conform to a twisted portion of lighting unit 1 and to the twist itself. The passage thus permits a lighting unit 1 to be inserted into the clamp 10 and held in place in the intended orientation at the twisted portion of the lighting unit.

Body member 12 is made of a shape retaining material to provide proper support for holding the lighting unit twisted in its intended orientation.

As shown in FIG. 2 the surface located inwardly of end wall 20 includes a planar portion 28 that extends partially across a portion of the passage width and would be juxtaposed with a vertical wall, such as in portion 4 of the lighting unit. Similarly, a planar portion 30 is on the lower portion of the surface inwardly of side wall 16. Upwardly from the planar portion 30 is an indent formed by an inclined surface 32 which merges with an inclined surface 34. This indent facilitates insertion of the lighting unit and reduces the strain that would be experienced along the edge of the lighting unit. The top wall 24 has an undulated curved configuration 36 which merges with surface 32.

The surface inwardly of end wall 20 also includes downwardly sloping inwardly directed portions 38 and 40. The top 37 of portions 38 and 40 form an undulated curve spaced from and generally of the same shape and generally parallel to curvature 36. The curvy shape resulting from the various slopes and curvatures of passage or slot 26 resembles a fusilli shape similar to fusilli pasta, and accommodates and stabilizes the twist and an adjacent portion of the lighting unit. In that regard, the parallel surfaces 28 and 30 are dimensioned and spaced from each other to hold a portion of the lighting unit twisted in its intended orientation such as the vertical orientation 4 of FIG. 1. The remainder of passage 26 receives the twist itself.

FIG. 2 also shows an extension 42 provided outwardly of one of the end walls, such as end wall 22. Extension 42 includes an aperture 44 extending completely therethrough to accommodate a fastening member, such as a screw or bolt to mount the clamp 10 in its intended position and thereby also fix the location of the lighting unit 1.

While the drawings illustrate the lighting unit to be twisted where its adjacent portions are 90 degrees offset from each other, it is to be understood that different angular twistings are possible. With different angular twistings, the clamp would have parallel surfaces disposed at those different angular orientations.

Although FIG. 2 illustrates body member 12 to be of generally rectangular cross-section, other embodiments in which the various side and end walls are not completely distinct from each other are possible. For example, the walls could smoothly merge into each other with a curve at their corners or with no corners at all.

It should be understood that the exemplary embodiments described herein should be considered in a descriptive sense only and not for purposes of limitation. Descriptions of features or aspects within each embodiment should typically be considered as available for other similar features or aspects in other embodiments. It will be understood by those of ordinary skill in the art that various changes in form and details may be made therein without departing from their spirit and scope.

What is claimed is:

1. A clamp for holding a twisted lighting unit comprising a body member having a base, spaced side walls extending upwardly from the base, spaced intermediate end walls extending upwardly from the base, a top wall at the upper ends of the side and end walls, a slot extending from the top wall toward the base from one of the end walls to one of the side walls to create a passage completely across the body member whereby a lighting unit may be inserted through the body member, the passage having spaced parallel planar surfaces over a portion of the width of the passage extending inwardly from the one side wall to be of a size and spacing to maintain a portion of the lighting unit located between the planar surfaces in the intended orientation, and the remainder of the passage being shaped to accommodate a twisted portion of the lighting unit.

2. The clamp of claim 1 wherein the top of the slot at the top wall has spaced curvatures.

3. The clamp of claim 2 wherein the spaced curvatures are generally parallel with each other.

4. The clamp of claim 3 wherein the passage includes an indent extending from the top wall to the planar surface remote from the one end wall.

5. The clamp of claim 4 wherein the indent comprises an upper slanted surface merging with a lower slanted surface, and the lower slanted surface merging with the remote planar surface.

6. The clamp of claim 5 wherein the passage includes adjacent sloping surfaces extending downwardly from the top wall remote from the indent.

7. The clamp of claim 6 wherein the body member includes an extension extending outwardly from the base for accommodating a fastener.

8. The clamp of claim 7 wherein the extension has an aperture for receiving a fastener.

9. The clamp of claim 2 wherein the passage includes an indent extending from the top wall to the planar surface remote from the one end wall.

10. The clamp of claim 9 wherein the passage includes adjacent sloping surfaces extending downwardly from the top wall remote from the indent.

11. The clamp of claim 10 wherein the body member includes an extension extending outwardly from the base for accommodating a fastener.

12. The clamp of claim 1 wherein the passage includes an indent extending from the top wall to the planar surface remote from the one end wall.

13. The clamp of claim 1 wherein the body member includes an extension extending outwardly from the base for accommodating a fastener.

14. The clamp of claim 1, in combination with a lighting unit having at least two adjacent portions offset from each other by an interconnecting twist, and the twist being in the passage.

15. The clamp of claim 14 wherein the adjacent portions are perpendicularly offset from each other, and part of one of the portions being between the planar surfaces.

16. The clamp of claim 14 wherein the lighting unit comprises a PCB embedded in a flexible casing.

17. A method of maintaining a twisted lighting unit in its twisted condition comprising providing the clamp of claim 1, and mounting the clamp on the lighting unit with the twist of the lighting unit inserted in the passage.

* * * * *